US005213425A

United States Patent [19]

Adachi et al.

[11] Patent Number: 5,213,425

[45] Date of Patent: May 25, 1993

[54] PLATEN DRIVE DEVICE

[75] Inventors: Tetsuya Adachi, Kurume; Yuji Tanaka, Chikushino, both of Japan

[73] Assignee: Matsushita Electric Industrial Co., Ltd., Osaka, Japan

[21] Appl. No.: 683,804

[22] Filed: Apr. 11, 1991

[30] Foreign Application Priority Data

Apr. 17, 1990 [JP] Japan ..... 2-101312

[51] Int. Cl.[5] ..... B41J 19/76

[52] U.S. Cl. ..... 400/572; 400/575; 74/820

[58] Field of Search ..... 400/648, 659, 650–656, 400/550, 551, 552, 553, 555, 556, 561.1, 563, 564, 564.1, 567, 569, 577, 572, 575; 74/820, 436

[56] References Cited

U.S. PATENT DOCUMENTS

| | | | |
|---|---|---|---|
| 442,404 | 12/1890 | Steiger | 74/436 |
| 578,303 | 3/1897 | Wolfe | 74/436 |
| 1,552,598 | 9/1925 | Drissner et al. | 74/820 |
| 1,726,731 | 9/1929 | Bartlett et al. | 74/436 |
| 2,589,486 | 3/1952 | Emrick | 74/820 |
| 2,598,448 | 5/1952 | Schultz | 74/820 |
| 2,769,379 | 11/1956 | Perry | 74/436 |
| 3,236,116 | 2/1966 | Hafferkamp et al. | 74/820 |
| 3,260,343 | 7/1966 | McCormick | 74/436 |
| 3,390,757 | 7/1968 | Edwards et al. | 74/820 |
| 3,487,905 | 1/1970 | James, Sr. | 74/436 |
| 3,613,857 | 10/1971 | Thevis et al. | 408/226 |
| 3,808,969 | 5/1974 | Pearce | 101/72 |
| 3,831,458 | 8/1974 | Takanashi et al. | 74/436 |
| 3,840,167 | 10/1974 | Mack et al. | 74/436 |
| 4,056,321 | 11/1977 | Gensike et al. | 353/99 |
| 4,104,071 | 8/1978 | Crissy | 355/54 |
| 4,217,057 | 8/1980 | Nakamura | 400/626 |
| 4,244,290 | 1/1981 | Tamai et al. | 400/636 |
| 4,317,385 | 3/1982 | Harvey et al. | 74/820 |
| 4,403,878 | 9/1983 | Hosogaya | 400/605 |
| 4,500,217 | 2/1985 | Swindler | 400/320 |
| 4,522,519 | 6/1985 | DuBois | 400/629 |
| 4,724,760 | 2/1988 | Bubley | 101/115 |

FOREIGN PATENT DOCUMENTS

| | | | |
|---|---|---|---|
| 53-27814 | 3/1978 | Japan . | |
| 337100 | 10/1936 | United Kingdom | 74/436 |

OTHER PUBLICATIONS

"Designing for Intermittent Motion" Karl E. Kist, A Paper from the Third Conference on Mechanisms, Machine Design, Oct. 4, 1956, pp. 100–103.

"Drive Clutch" IBM Technical Disclosure Bulletin vol. 26, No. 9 Feb. 1984 pp. 4573–4574.

"Combined Vertically Reciprocating and Rotary Indexing Mechanism" IBM Tech. Discl. Bulletin, vol. 10 No. 8 Jan. 1968 pp. 1217–1218.

*Primary Examiner*—Eugene H. Eickholt

*Attorney, Agent, or Firm*—Stevens, Davis, Miller & Mosher

[57] ABSTRACT

A device for driving a platen includes a motor for driving the platen, and a power transmission mechanism for transmitting the power of the motor to the platen. The power transmission mechanism includes a drive wheel having a pin and driven by the motor for rotation, and a driven wheel having a plurality of grooves in which the pin of the drive wheel is engageable. With this construction, the platen can be rotated and stopped.

3 Claims, 3 Drawing Sheets

PLATEN DRIVE DEVICE

BACKGROUND OF THE INVENTION

This invention relates to a platen drive device for use in a printer, an electronic typewriter or the like.

A platen drive device has conventionally been used to drive a platen of a printer, an electronic typewriter or the like.

Such a conventional platen drive device will now be described. FIG. 4 is a side-elevational view of the conventional platen drive device. A drive gear 22 is mounted on a shaft of a motor 21, and a gear 24 having a worm 23 integrally formed therewith is in mesh with the drive gear 22. As best shown in FIG. 5, the worm 23 has teeth formed on a part of its outer peripheral surface, the teeth (hereinafter referred to as "spiral teeth") being disposed on a spiral line. A teeth-free portion, i.e. a portion at which the spiral teeth are cut off or removed is provided on the outer peripheral surface of the worm 23. A reflection plate 24*a* is mounted on one side or face of the gear 24. A worm gear 25 is engageable with the spiral teeth of the worm 23, and also is in mesh with teeth of a ratchet 27 mounted coaxially with a platen 26. An arm 29 is urged against the teeth of the ratchet 27. A photosensor 30 is fixedly mounted in such a position as to be opposed to the reflection plate 24*a* when the worm 23 is disengaged from the worm gear 25. A motor braking judgment portion 31 feeds a braking signal to a motor driver 32 (which drives the motor 21) when a detection signal is outputted from the photosensor 30.

The operation of the above platen drive device will now be described.

First, when the motor 21 is in its stopped condition, the worm 23 and the worm gear 25 are stationary, and are not engaged or meshed with each other. In this condition, when the motor 21 begins to rotate, the worm 23 is soon brought into meshing engagement with the worm gear 25, so that the worm gear 25 begins to thereby rotate to drive the platen 26. Then, the worm 23 is further rotated, and when the worm 23 is disengaged from the worm gear 25, the worm gear 25 is stopped. At this time, the platen 26 is retained in this position by the engagement of the arm 29 with the ratchet 27. Also, at this time, the photosensor 30 outputs a detection signal, and the motor braking judgment portion 31 is responsive to this detection signal to feed a stop signal to the motor driver 32, so that the motor driver 32 stops the motor 21. At this time, the stop position of the motor is irregular. However, if the range of this position irregularity is arranged to be within the range of the teeth-free portion of the worm 23, the platen can be angularly moved a certain amount regardless of the stop position of the motor 21. And besides, the only means for retaining the platen 26 in a braked condition when the motor 21 is stopped is the ratchet mechanism constituted by the ratchet 27 and the arm 29, and therefore, the platen 26 can be manually rotated.

However, with the above conventional construction, the plurality of teeth of the worm are intermittently engaged or meshed with the plurality of teeth of the worm gear, and therefore if the relation between the engaging position of the ratchet mechanism and the engaging position of the worm gear is not constant, the position of the worm gear is changed after the worm is disengaged from the worm gear. In such a case, the next engagement of the worm with the worm gear can not be done properly. For this reason, the design of the ratchet mechanism is difficult, and the manufacturing precision of the ratchet mechanism as well as the manufacturing precision of the worm and the worm gear must be enhanced. As a result, the cost has been increased.

SUMMARY OF THE INVENTION

It is an object of this invention to provide a platen drive device which can positively rotate and stop a platen without the need for enhancing the manufacturing precision of component parts of a power transmission portion for transmitting power from a motor to the platen.

According to the present invention, there is provided a device for driving a platen, comprising:

a motor for driving the platen; and power transmission means for transmitting the power of the motor to the platen, the power transmission means comprising a drive wheel having a pin and driven by the motor for rotation, and a driven wheel having a plurality of grooves in which the pin of the drive wheel is engageable.

DESCRIPTION OF THE PREFERRED EMBODIMENT

Figure 1A:
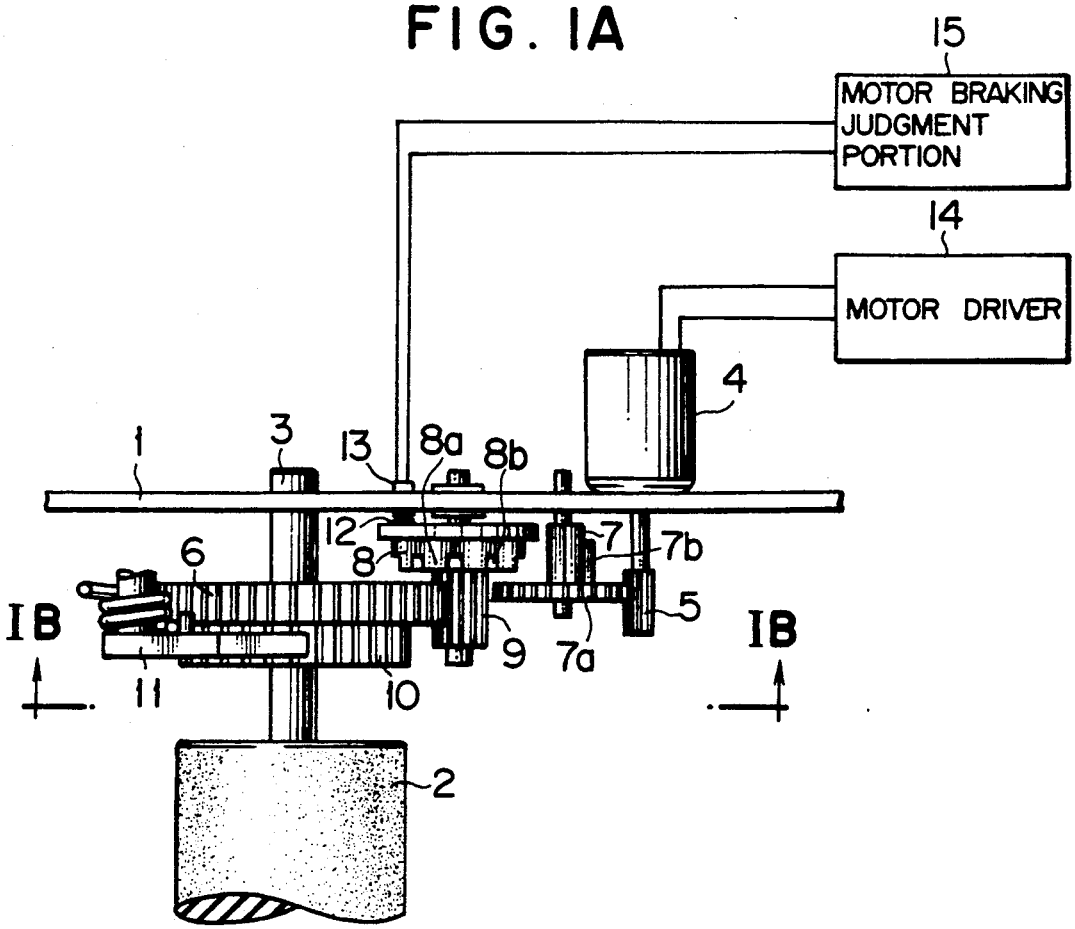
FIG. 1A is a top plan view of a platen drive device according to an embodiment of the present invention.
Figure 1B:
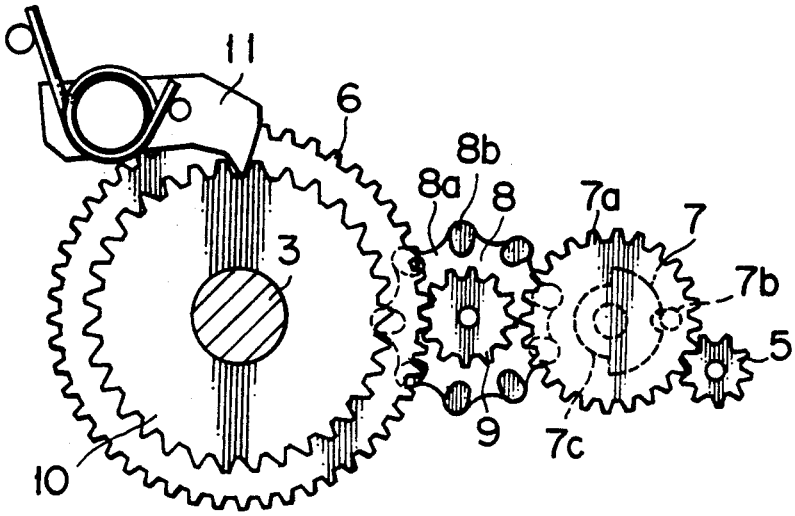
FIG. 1B is a cross-sectional view taken along the line 1B—1B of FIG. 1A.

FIG. 1A is a top plan view of a platen drive device according to an embodiment of the present invention, and FIG. 1B is a cross-sectional view taken along the line 1B—1B of FIG. 1.

Figure 2A:
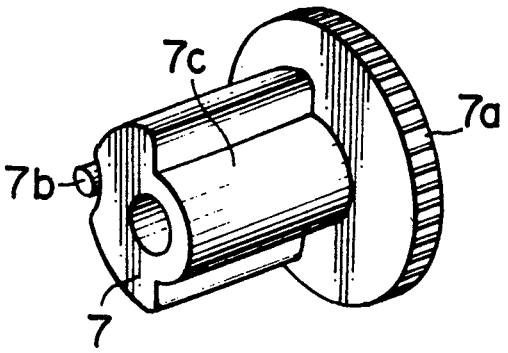
FIGS. 2A and 2B are perspective views of a Geneva drive wheel of the platen drive device.
Figure 2B:
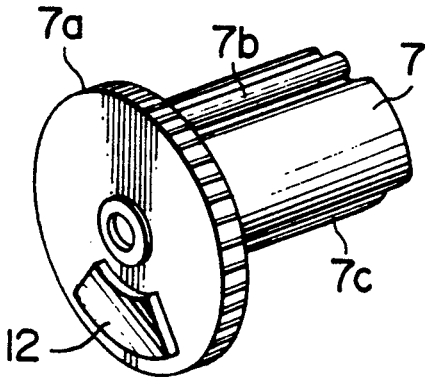
Figure 3:
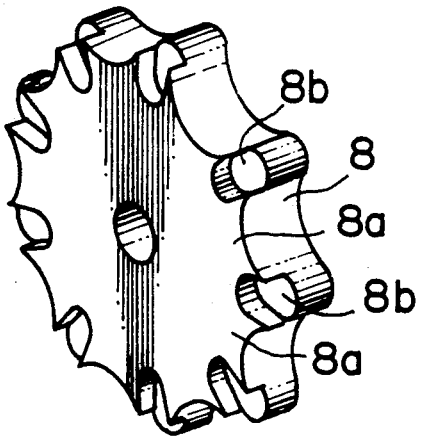
FIG. 3 is a perspective view of a Geneva driven wheel of the platen drive device.
Figure 5:
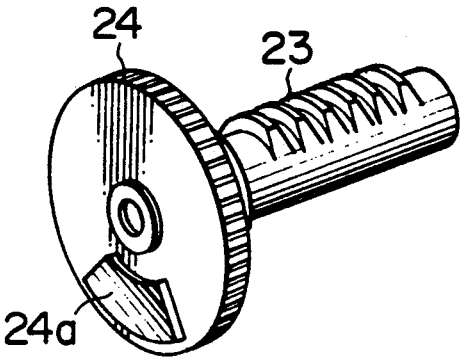
FIG. 5 PRIOR ART
FIG. 5 is a perspective view of a worm of the conventional platen drive device.
Figure 4:
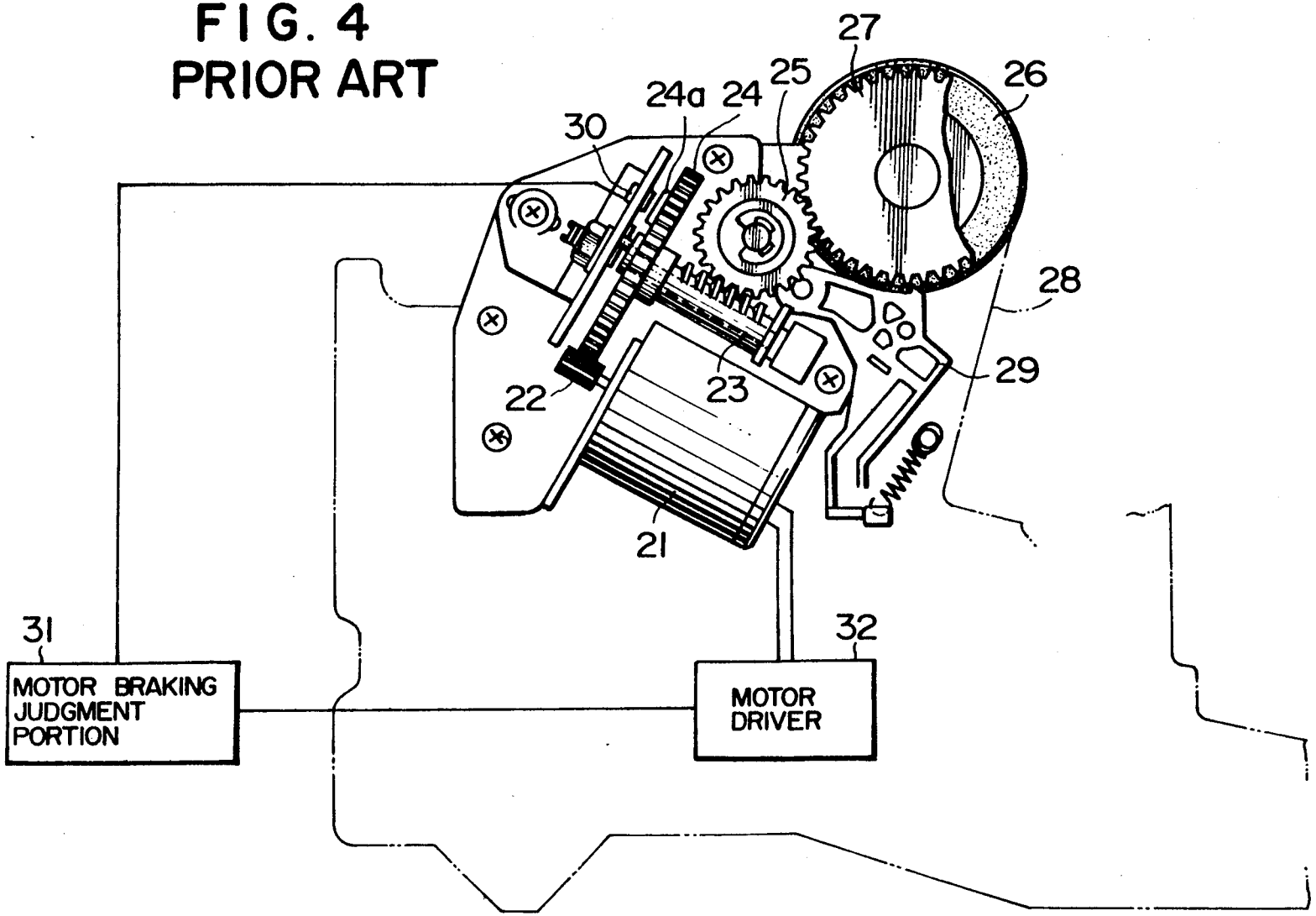
FIG. 4 PRIOR ART
FIG. 4 is a side-elevational view of a conventional platen drive device.

In FIGS. 1A and 1B, reference numeral 1 denotes a side plate, and a platen 2 is mounted on a platen shaft 3. A drive gear 5 is mounted on a shaft of a motor 4. A platen gear 6 is mounted on the platen shaft 3, and a Geneva drive wheel 7 has a gear 7*a* formed integrally therewith and meshed with the drive gear 5. As best shown in FIGS. 2A and 2B, a notched portion 7*c* is formed in that side of the outer peripheral surface of the Geneva drive wheel 7 facing away from a feed pin 7*b* which is formed at the outer peripheral portion of the Geneva drive wheel 7. As shown in FIG. 3, a Geneva driven wheel 8 has a plurality of radial fins 8*a* corresponding in shape to the arcuate outer periphery of the drive wheel 7, and guide grooves 8*b* each provided between respective adjacent ones of the fins 8*a*. When the drive wheel 7 is rotated by the motor 4, the pin 7*b* is engaged in the guide grooves 8*b* to intermittently rotate the driven wheel 8. The driven wheel 8 is mounted on a gear 9 coaxially therewith, and the gear 9 is in mesh with the platen gear 6. A ratchet 10 is mounted on the platen shaft 3, and an arm 11 is engaged with the ratchet 10 to retain the platen 2. As shown in FIG. 2B, a reflection plate 12 is mounted on the gear 7*a*. A photosensor 13 is mounted in such a position as to be opposed to the reflection mirror 12 when the pin 7*b* is disengaged from the guide groove 8*b*. A motor driver 14 drives the motor 4. When a detection signal is outputted from the photosensor 13, a motor braking judgment portion 15 feeds a braking signal to the motor driver 14 so as to brake the motor 4.

The operation of the platen drive device of the above construction will now be described.

First, when the motor 4 is in its stopped condition, the drive wheel 7 and the driven wheel 8 are not engaged with each other. In this condition, when the motor 4 begins to rotate, the arcuate outer peripheral portion of the drive wheel 7 is first brought into contact with the fin 8*a*, and the positions of the drive wheel 7 and the driven wheel 8 are so corrected that the can be engaged in the guide groove 8*b*. Then, the pin 7*b* can be engaged in the guide groove 8*b*. Then, the pin 7*b* of the drive wheel 7 is engaged in the guide groove 8*b* of the driven wheel 8, so that the driven wheel 8 begins to rotate to thereby drive the platen 2. Thereafter, the drive wheel 7 is further rotated, and when the pin 7*b* is disengaged from the guide groove 8*b*, the driven wheel 8 is stopped. The platen 2 is retained in this stopped position by the engagement of the arm 11 with the ratchet 10. Also, at this time, the photosensor 13 outputs a detection signal, and the motor braking judgment portion 15 is responsive to this detection signal to feed a motor braking signal to the motor driver 14, and the motor driver 14, when receiving this braking signal, stops the motor 4. At this time, the stop position of the motor 4 is irregular. However, if the range of this position irregularity is arranged to be within the range of the notched portion 7*c*, the only means for retaining the platen 2 in a braked condition when the motor 4 is stopped is the ratchet mechanism constituted by the ratchet 10 and the arm 11. Therefore, the platen 2 can be manually rotated.

As described above, in this embodiment, before the pin 7*b* of the driven wheel 7 is engaged in the guide groove 8*b* of the driven wheel 8, the arcuate outer peripheral portion of the drive wheel 7 is contacted with the fin 8*a* of the driven wheel 8, thereby correcting the positions of the drive wheel 7 and the driven wheel 8 in such a manner that the pin 7*b* can be engaged in the guide groove 8*b*. Thereafter, the pin 7*b* is engaged in the guide groove 8*b*. Therefore, even if the engaging position of the ratchet mechanism is not proper for the positions of the pin 7*b* and the guide groove 8*b*, the pin 7*b* can be properly engaged in the guide groove 8*b*. Therefore, the ratchet mechanism can be designed easily, and the cost can be reduced.

What is claimed is:

1. A device for driving a platen, comprising:

a motor; and power transmission means for transmitting a power output of said motor to the platen, said power transmission means including a Geneva drive wheel having a pin and driven to rotate by said motor, and a Geneva driven wheel having a plurality of grooves in which said pin of said drive wheel is engageable, said drive wheel having a notched portion formed in part of an outer peripheral surface thereof, said notched portion facing said Geneva driven wheel when said motor is stopped to enable manual rotation of said platen.

2. A device for driving a platen, comprising:

a ratchet mechanism for retaining a position of the platen when the motor is stopped;

a motor; and power transmission means for transmitting a power output of said motor to the platen, said power transmission means including a Geneva drive wheel having a pin and driven to rotate by said motor, and a Geneva driven wheel having a plurality of grooves in which said pin of said drive wheel is engageable, said drive wheel having a notched portion formed in part of an outer peripheral surface thereof, said notched portion facing said Geneva driven wheel when said motor is stopped to enable manual rotation of said platen.

3. A device according to claim 2, further comprising braking means for braking said motor when said drive wheel is disengaged from said driven wheel.

* * * * *